US006434245B1

(12) United States Patent
Zimmermann

(10) Patent No.: US 6,434,245 B1
(45) Date of Patent: Aug. 13, 2002

(54) COMPOUND ELECTROLYTIC LOUDSPEAKER ASSEMBLY

(76) Inventor: Claus Zimmermann, 1000 Business Center Cir. Thousand Oaks Business Center, Suite 107, Newbury Park, CA (US) 91320

( * ) Notice: Subject to any disclaimer, the term of this patent is extended or adjusted under 35 U.S.C. 154(b) by 0 days.

(21) Appl. No.: 09/889,873

(22) PCT Filed: Jan. 24, 2000

(86) PCT No.: PCT/US00/01779

§ 371 (c)(1),
(2), (4) Date: Jul. 23, 2001

(87) PCT Pub. No.: WO00/44199

PCT Pub. Date: Jul. 27, 2000

Related U.S. Application Data

(60) Provisional application No. 60/117,060, filed on Jan. 25, 1999.

(51) Int. Cl.[7] ..... H04R 25/00

(52) U.S. Cl. ..... 381/191; 381/113; 381/174

(58) Field of Search ..... 381/191, 113, 381/174, 116; 310/321, 311

(56) References Cited

U.S. PATENT DOCUMENTS 5,392,358 A * 2/1995 Driver ..... 381/191

* cited by examiner

*Primary Examiner*—Sinh Tran
(74) *Attorney, Agent, or Firm*—Albert O. Cota

(57) ABSTRACT

A compound electrolytic loudspeaker (10) comprising two major elements: a capacitive transducer (12) and a transducer driver unit (116). The capacitive transducer (12) consist of a compound diaphragm (14) that is suspended within a frame assembly (84) and which consists of a front stator (16) having a front stator electrode (32), a rear stator (34) having a rear stator electrode (50), and a center diaphragm (54) having a diaphragm electrode (68). The electrodes interface with the transducer driver unit (116) which receives and amplifies an audio signal applied from a receiver-amplifier (126). The amplified audio signal drives the capacitive transducer (12) in synchrony with the reveived audio. The capacitive transducer (12) is designed to be used singularly or be positioned in several selectable placement configurations including a side-by-side configuration, a stacked vertical configuration and in a horizontal configuration wherein an inner surface (88) of a first frame assembly (84) abuts with an outer surface (90) of a second frame assembly (84).

18 Claims, 3 Drawing Sheets

COMPOUND ELECTROLYTIC LOUDSPEAKER ASSEMBLY

This application claims priority from provisional application Ser. No. 60/117,060, filed Jan. 25, 1999.

TECHNICAL FIELD

The invention pertains to the general field of electrolytic loudspeakers and more particularly to a compound electrolytic loudspeaker assembly that has at least two frame-enclosed capacitive transducers which can be arranged in various physical configurations and driven by a single transducer driver unit.

BACKGROUND ART

Audio engineers have long endeavored to develop loudspeakers that are relatively free from distortion and that have a frequency response which allows all types of music to be closely reproduced. Loudspeakers are categorized as being either magnetic speakers, moving coil speakers, or non-magnetic, electrostatic speakers/transducers. Due to the fact that the instant invention is categorized as electrostatic, this background art will focus on these types of loudspeakers.

Most conventional electrostatic speakers consist of a flexible center membrane or diaphragm having on each side a fixed electrode, which is designed in the shape of a grid of wires. The wires are placed apart, thereby enabling sound waves, which are generated by the movement of the flexible membrane, to be emitted. The wires are held within a dielectric insulation material, and the flexible membrane is coated with a highly-resistive material. The membrane is suspended within an open-latticed frame between the electrode wires so that when operated, relatively small segments of the diaphragm vibrate as a result of the electrostatic fields acting upon the diaphragm.

Electrostatic speakers are considered to be superior in many respects over the moving-coil type of speakers. However, they have received generally poor acceptance as a result of the mechanical complexity of some designs, low acoustic output, the requirement for a comparatively large radiating area, and a dependence upon the application of a relatively high d-c polarizing bias voltage between the flexible diaphragm and the wire grid electrodes. For example, a typical full range push-pull electrostatic speaker requires a bias voltage of 3500 volts d-c and a driving amplifier with a power capacity of from 60 to 100 watts. Additionally, electrostatic speakers are only able to capably reproduce mid-range and higher audible frequencies. As a result of this it is usually necessary to utilize a bass speaker, which can be connected to the loudspeaker assembly or be a separate module, such as a sub-woofer.

To alleviate some of the above problems, transducers utilizing electrets as the diaphragm have been utilized. The electret diaphragm was thought to be permanently polarized or charged, and therefore did not require a separate polarizing d-c voltage. However, these electrets have been found to be unsatisfactory for application as loudspeakers because the audio level has a tendency to decay.

A search of the prior art did not disclose any patents that read directly on the claims of the instant invention however, the following U.S. patents were considered related:

| U.S. Pat. No. | Inventor | Issue Date |
|---|---|---|
| 5,392,358 | Driver | February 21, 1995 |
| 4,160,882 | Driver | July 10, 1979 |
| 3,942,029 | Kawakami, et al | March 2, 1976 |
| 3,705,312 | Sessler, et al | December 5, 1971 |
| 3,345,469 | Rod | October 3, 1967 |

The U.S. Pat. No. 5,392,358 Driver patent discloses an improved electrolytic loudspeaker assembly that is designed to reproduce a broadband of audio signals. The loudspeaker assembly consists of a thin, non-magnetic capacitive transducer and a transducer driver unit. The transducer consists of a compound diaphragm further consisting of a vibratory center section having attached to each of its surfaces a respective front section and a back section. All three sections of the compound diaphragms are held captive by a frame assembly. The transducer is driven and controlled by the transducer driver unit which couples the audio signal to the transducer's front and back sections and supplies an unregulated, d-c bias voltage to the transducer's center section. This patent is assigned MZX, INCORPORATED who is the applicant of the instant application.

The U.S. Pat. No. 4,160,882 Driver patent discloses an electrostatic transducer that functions as a loudspeaker. The transducer consists of two parallel diaphragms each consisting of two plastic sheets, having different charge carrying characteristics, that are sandwiched between an electrically conductive layer. The two diaphragms-are separated by a centrally located perforated electrically conductive sheet and a dielectric material sandwiched between the conductive sheet and each diaphragm. The diaphragm's two electrically conductive layers are connected across the secondary winding of an audio transformer and the centered electrically conductive sheet is connected to the center tap of the transformer. Thus, when the transformer is applied an audio signal the two diaphragms are driven in a push-pull relation to reproduce the audio.

The U.S. Pat. No. 3,942,029 Kawakami et al patent discloses an electrostatic transducer that can be utilized as either a speaker or microphone. The transducer consists of a vibrating plate or electret diaphragm having a monocharge of positive or negative potential on its surface. The electret diaphragm is made of a thin polymer film that is bonded to a support so that uniform tension exists. A pair of electrically conductive electrodes are brought in contact with opposite sides of the polymer films, and an electrostatic shield, such as a mesh, covers the surface of the two electrodes. A d-c voltage is time-applied across the electrodes to allow the electret to heat to its cure temperature of 120 degrees C. The electret is subsequently cooled to produce a quasi permanent state of electric polarization.

The U.S. Pat. No. 3,705,312 Sessler patent discloses a method for preparing a thin-film electret. The method includes placing a thin polymer film between two electrodes together with a dielectric plate. A voltage of about 30 kev is then applied across the resulting sandwich of elements for about one minute at room temperature and at atmospheric pressure. The method produces charge-densities which are greater by a factor of three than those previously reported.

The U.S. Pat. No. 3,345,469 Rod patent discloses a loudspeaker that operates on electrostatic principles. The speaker consists of a centrally located movable diaphragm which is coated on both sides with a thin, flexible electrically conductive layer. On each side of the diaphragm is located at least one hermetically sealed plastic dielectric sheet. When air or other gas is trapped between the sheets and the diaphragm, a buffer zone is created. To each outer-most dielectric sheet is attached an electrode and to the centered conductive diaphragm is likewise attached an electrode. The two buffer electrodes are connected across the secondary winding of a step-up transformer and the diaphragm electrode is connected through a d-c voltage source to a center-tap of the transformer. The transformer's primary winding is connected to the diaphragm driving signal that is derived from the signal input from a conventional low-impedance amplifier.

DISCLOSURE OF THE INVENTION

The compound electrolytic loudspeaker assembly disclosed herein is designed to reproduce a broadband of the audible spectrum. In its most basic design the assembly consists of:

a) A capacitive transducer comprising a compound diaphragm further comprising a front stator from where extends a front stator electrode, a rear stator from where extends a rear stator electrode and a center diaphragm from where extends a diaphragm electrode, b) a frame assembly designed to suspend the compound diaphragm in a manner which allows the center diaphragm to flex in a forward and rearward direction, and c) a transducer driver unit which interfaces with the first stator electrode, the rear stator electrode and the diaphragm electrode. When the unit is applied an audio signal, the unit passes the signal to the compound diaphragm where the signal drives the center diaphragm in synchrony with the applied audio signal.

The capacitive transducer is designed to be used singularly or a plurality of capacitive transducers can be electrically and physically interconnected and operated. Various series, parallel, and series-parallel combinations of capacitive transducers can be arranged to provide an optimum listening performance. As an example, four configurations are presented.

In the first configuration at least two capacitive transducers are placed in a side-by-side horizontal configuration. The second configuration is similar to the first with a space located between each pair of capacitive transducers. In the third configuration at least two capacitive transducers are stacked in a vertical configuration with the lower surface of one transducer placed on the upper surface of a second transducer. In the fourth configuration the capacitive transducers are arranged in a horizontal configuration with the inner surface of a first capacitive transducer abutting with the outer surface of a second transducer. In this fourth configuration each pair of transducers share a common stator. In all of the above configurations the electrodes can be electrically connected so that only three electrodes remain which are connected to the-transducer driver unit which is operated by an external audio source such as a receiver-amplifier.

In view of the above disclosure, it is the primary object of the invention to produce a basic capacitive transducer that can be electrically interconnected and physically positioned with other capacitive transducers to provide various placement configurations, and that can be operated by a single transducer driver unit.

In addition to the primary object of the invention it is also an object of the invention to produce a compound electrolytic loudspeaker assembly that:

does not require the high signal and bias voltage normally required to operate conventional electrolytic loudspeakers, can be located in various areas and positions that are not possible with current magnetic moving-coil loudspeakers, is reliable and easily maintained, can be produced by a process that is easily controlled and is time efficient, and is cost effective from both a consumer's and manufacturer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the compound electrolytic loudspeaker assembly 10 is presented in terms of a preferred embodiment that can be arranged in various placement configurations. The preferred embodiment, as shown in FIGS. 1–11, is comprised of two major elements: a capacitive transducer 12 and a transducer driver unit 116.

Figure 1:
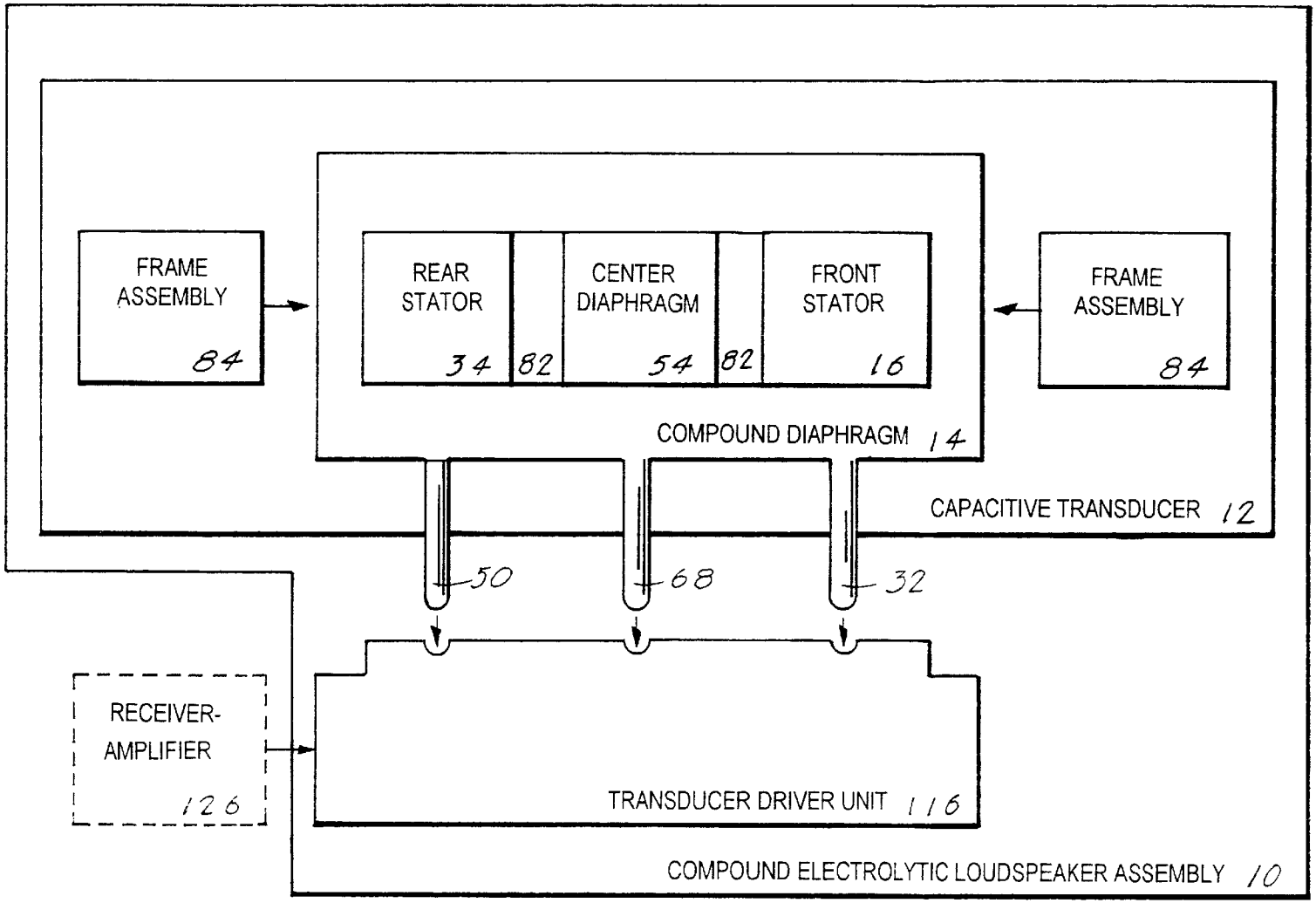
FIG. 1 is a block diagram of the compound electrolytic loudspeaker assembly which is comprised of a capacitive transducer and a transducer driver unit.
Figure 2:
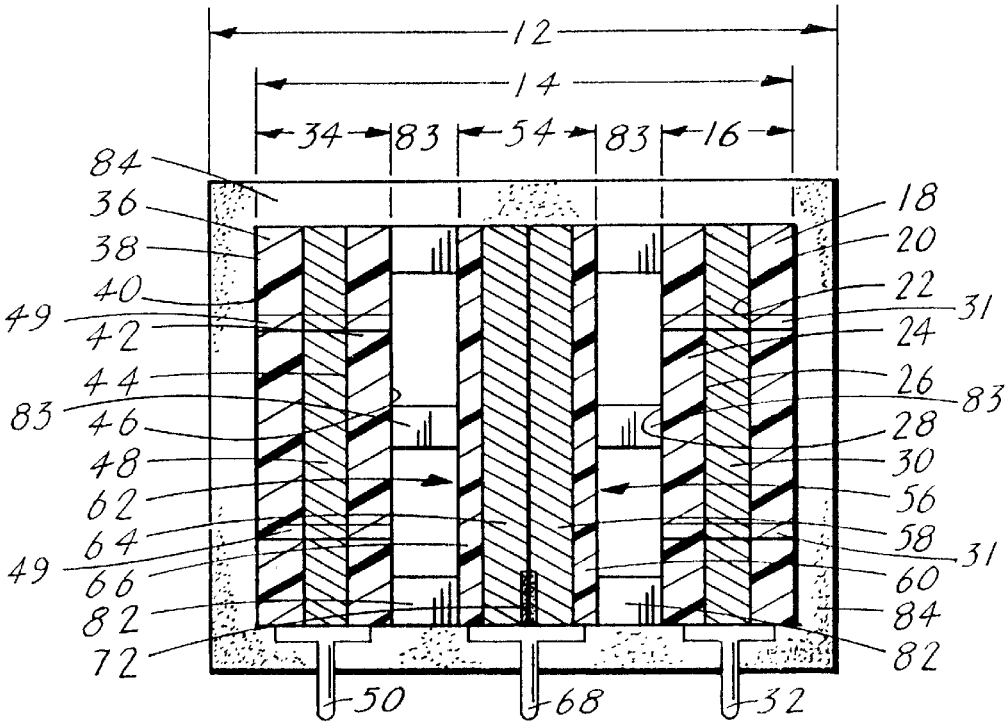
FIG. 2 is a cross-sectional view of the capacitive transducer.

The capacitive transducer 12, as shown in a block diagram in FIG. 1 and in an elevational-sectional view in FIG. 2, is comprised of a compound diaphragm 14 which is further comprised of a front stator 16, a rear stator 34 and a center diaphragm 54. The entire compound diaphragm 14 is suspended within a frame assembly 84.

The front stator 16, as shown in FIG. 2, consists of an integrated structure comprising an outer insulating member 18 having an outer side 20 and an inner side 22, and an inner insulating member 24 also having an outer side 26 and an inner side 28. Between the inner side 22 of the outer insulating member 18 and the outer side 26 of the insulating member 24 is positioned a conductive layer 30. Penetrating the front stator 16 is a plurality of lateral front stator perforations 31. In electrical contact with the front stator 16 is a front stator electrode 32 which interfaces with the transducer driver unit 116 as shown in FIG. 1.

The rear stator 34, as also shown in FIG. 2, consists of a similar integrated structure as the front stator and comprises an outer insulating member 36 having an outer side 38 and an inner side 40, and an inner insulating member 42 also having an outer side 44 and an inner side 46. Between the inner side 40 of the outer insulating member 36 and the outer side 44 of the inner insulating member 42 is positioned a conductive layer 48. Penetrating the rear stator is a plurality of lateral rear stator perforations 49. In electrical contact with the rear stator 34 is a rear stator electrode 50 which also interfaces with the transducer driver unit 116 as shown in FIG. 1.

The outer and inner insulating members 18,24 of the first stator 16 and the outer and inner insulating members 36,42 of the rear stator 34 are constructed of non-conductive material such as plastic. The conductive layer 30,48 can consist of a conductive metal 76 or a conductive solution 78, such as a paint having suspended metal particles, that is sprayed onto the inner sides of the outer and inner insulating members 18,30. Also, at least the outer insulating member 18 or the inner insulating member 24 of the front stator 16 and the outer insulating member 36 or the inner insulating member 42 of the rear stator 34 are constructed of a material that offers sufficient structural integrity.

The third and final element that comprises the compound diaphragm 14 is the center diaphragm 54. The diaphragm is positioned in a spaced relationship by means of a spacing element 82, between the inner side 22 of the front stator 16 and the inner side 40 of the rear stator 34 as shown in FIGS. 1 and 2. The center diaphragm 54 is comprised of a first film 56 and a second film 62. The first film has a conductive surface 58 that faces inward and a non-conductive surface 60 that faces outward. Likewise, the second film 62 has a conductive surface 64 that faces inward and a non-conductive surface 66 that faces outward. As shown in FIG. 2, the conductive surface 58 on the first film 56 and the conductive surface 64 on the second film 62 can be in direct contact, or a thin resilient or bonding material 72, as also shown in FIG. 2, can be located between the two conductive surfaces. The resilient material 72 can consist of a separate sheet of material or can be sprayed onto the two interfacing surfaces or onto a single surface of the conductive surface 58,64. In electrical contact with the center diaphragm 54 is a diaphragm electrode 68 which also interfaces with the transducer driver unit 116. The transducer driver unit 116 is designed to accept an audio signal provided by an external audio source such as a receiver-amplifier 126 as shown in broken lines in FIG. 1. The transducer driver unit 116 produces a signal corresponding to the audio signal which causes the center diaphragm 54 to flex in synchrony with the audio signal to produce an audio output. The audio output is applied through the perforations 31,49, located respectively on the front and rear stators 16,34 to the outside environment.

The spacing element .82 separating the center diaphragm 54 from the front and rear stator 16,34 can consist of single standoff that is dimensioned to fit around the perimeter edge of the center diaphragm 54. Alternatively, the spacing element 82 can consist of a plurality of standoffs 83 that are selectively positioned around the non-conductive surfaces 60,66 of the center diaphragm 54. By selectively spacing and altering the quantity of standoffs 83, the frequency response of the assembly 10 can be adjusted to provide a desired effect.

Figure 9:
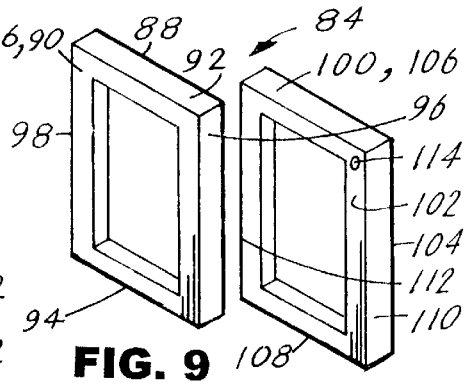
FIG. 9 is a perspective view of a frame assembly consisting of a front section and a rear section.
Figure 10:
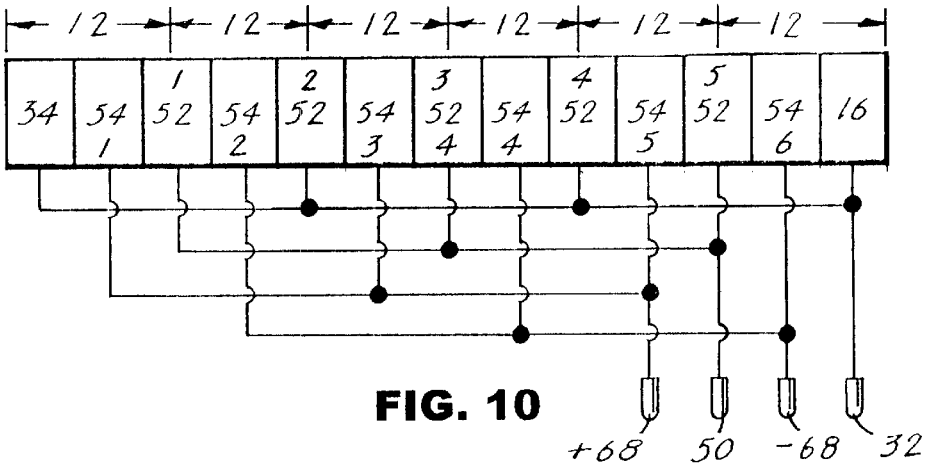
FIG. 10 is a block diagram showing a single front stator and a single rear stator that are shared by a plurality of center diaphragms and common stators.

The entire compound diaphragm 14 is held in a suspended configuration by the frame assembly 84 as shown in FIGS. 2 and 10. The frame assembly 84 is attached to the compound diaphragm 14 in a manner which allows the center diaphragm to flex in a forward and backward direction in synchrony with an audio signal applied by the transducer driver unit 116. The frame assembly, as best shown in FIG. 9, consists of a front section 86 and a rear section 100. The front section 86 includes an inner surface 88, an outer surface 90, an upper surface 92, a lower surface 94, a right surface 96 and a left surface 98. Likewise, the rear section 100 includes an inner surface 102, an outer surface 104, an upper surface 106, a lower surface 108, a right surface 110 and a left surface 112. The two frame sections 86,100 can be made of any non-conductive material and are held together by an attachment means 114, such as screws, clamps or an adhesive.

The compound electrolytic loudspeaker assembly 10 is fabricated with a capacitive transducer 12 that can be made in various practical dimensions such as 12 by 16 inches (30.5 by 40.6 cm). A single assembly 10 can be used or various configurations using multiple capacitive transducers with a single transducer driver unit 116 can also be used. Four such multiple configurations are disclosed as examples in FIGS. 5–10.

Figure 3:
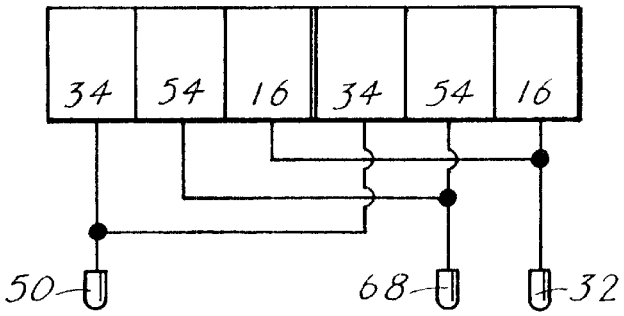
FIG. 3 is a block diagram showing a pair of front stator electrodes, a pair of rear stator electrodes and a pair of diaphram electrodes electrically connected in parallel to produce a single front stator electrode, a single rear stator electrode and a single diaphragm electrode.
Figure 5:
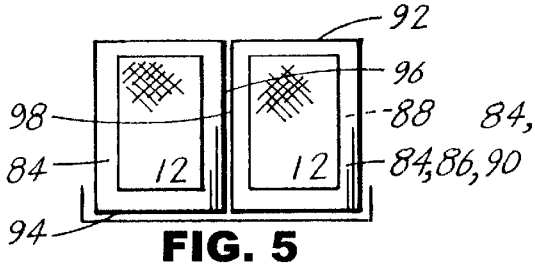
FIG. 5 is a front elevational view showing two capacitive transducers placed in a horizontal configuration with the right surface of a first frame assembly abutting the left surface of a second frame assembly.

In FIG. 5 a first configuration is shown wherein at least two said capacitive transducers 12 are placed in a horizontal configuration with the right surface 96 of a first frame assembly 84 abutting the left surface 98 of a second frame assembly 84. In this configuration the front stator electrodes 32, the rear stator electrodes 50 and the diaphragm electrodes 68 are electrically connected in parallel to produce, as shown in FIG. 3, a single front stator electrode 32, a single rear stator electrode 50 and a single diaphragm electrode wherein the three single electrodes interface with the transducer driver unit 116.

Figure 4:
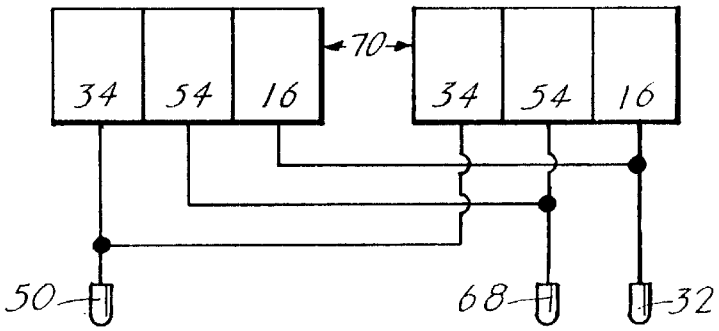
FIG. 4 is a block diagram showing a front stator electrode, a rear stator electrode and a diaphragm electrode electrically connected to in parallel to produce a single front stator electrode, a single rear stator electrode and a single diaphragm electrode.
Figure 6:
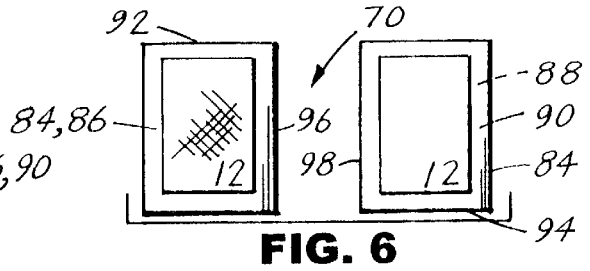
FIG. 6 is a front elevational view showing two capacitive transducers placed in a horizontal configuration with the right surface of a first frame assembly spaced apart from the left surface of a second frame assembly.

In FIG. 6, a second configuration is shown wherein at least two capacitive transducers 12 are placed in a horizontal configuration with the right surface 96 of a first frame assembly 84 spaced apart from the left surface 98 of a second frame assembly 84 by means of a spacer 70. In this configuration the front stator electrodes 32, the rear stator electrodes 50 and the diaphragm electrodes 68 are electrically connected in parallel to produce, as shown in FIG. 4, a single front stator electrode 32, a single rear stator electrode 50 and a single diaphragm electrode 68, wherein the three single electrodes interface with the transducer drive unit 116.

Figure 7:
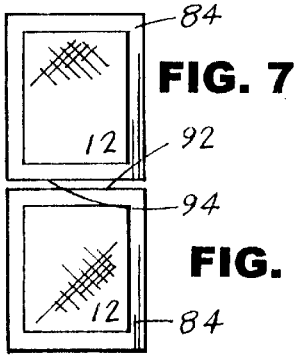
FIG. 7 is a front elevational view showing two capacitive transducers placed in a vertical configuration with the upper surface of a first frame assembly abutting the lower surface of a second frame assembly.

In FIG. 7 is shown a third configuration wherein at least two capacitive transducers 12 are placed in a vertical configuration with the upper surface 92 of a first frame assembly 84 abutting with the lower surface 94 of a second frame assembly 84. In this configuration the front stator electrodes 32, the rear stator electrodes 50 and the diaphragm electrodes 68 are electrically connected in parallel to produce a single front stator electrode 32, a single rear stator electrode 50 and a single diaphragm electrode 68, wherein the three single electrodes interface with the transducer driver unit 116.

Figure 8:
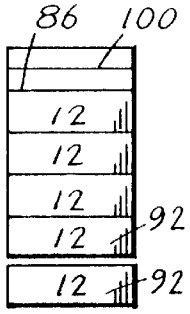
FIG. 8 is a top plan view in which a plurality of capacitive transducers are located with the inner surface of a first frame assembly abutting with the outer surface of a second frame assembly.

FIGS. 8 and 9 show the fourth configuration, wherein at least two capacitive transducers 12 are placed in a horizontal configuration with the inner surface 88 of a first frame assembly 84 abutting with the outer surface 90 of a second frame assembly 84. As shown in FIG. 9, in this configuration a common stator 52 is utilized, thus, if six capacitive transducers 12 are used, seven stators 52 and six center diaphragms 54 will be required.

Electrically, as also shown in FIG. 9, the rear stator 34 is sequentially connected to the second common stator 52, the fourth common stator 52 and to the front stator 16 which terminates with the front stator electrode 32. The first common stator 52 is connected to the third common stator 52 and to the fifth common stator which terminates with the rear stator electrode 50. The first, third and fifth center diaphragms 54 are sequentially connected as are the second, fourth and sixth diaphragms 54. Both of the center diaphragm sequences terminate at a diaphragm electrode 68 which is connected to either a positive or a negative bias voltage. The polarity of the bias voltage is dependent upon the design of the transducer driver unit 116.

Figure 11:
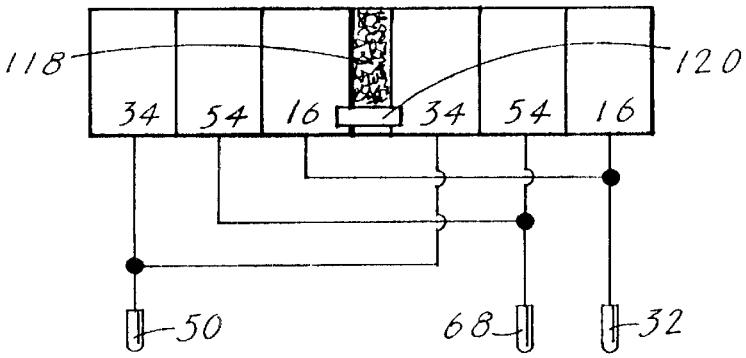
FIG. 11 is a block diagram showing two capacitive transducers maintained in an abutted configuration by means of an adhesive.

In FIG. 11 is shown a method by which two capacitive transducers 12 are maintained in an abutted configuration by means of an adhesive 118 or a plurality of clamps 120.

While the invention has been described in complete detail and pictorially shown in the accompanying drawings, it is not to be limited to such details, since many changes and modifications may be made in the invention without departing from the spirit and scope thereof Hence, it is described to cover any and all modifications and forms which may come within the language and scope of the appended claims.

What is claimed is:

1. A compound electrolytic loudspeaker assembly comprising:

A. a capacitive transducer comprising:

a) a compound diaphragm further comprising:

1) a front stator comprising:

(a) an outer insulating member having an outer side and an inner side, (b) an inner insulating member having an outer side and an inner side, (c) a conductive layer positioned between the inner side of the outer insulating member and the outer side of the inner insulating member, (d) a plurality of lateral perforations, (e) a front stator electrode in electrical contact with said front stator, 2) a rear stator comprising, (a) an outer insulating member having an outer side and an inner side, (b) an inner insulating member having an outer side and an inner side, (c) a conductive layer located between the inner side of the outer insulating member and the outer side of the inner insulating member, (d) a plurality of lateral perforations, (e) a rear stator electrode in electrical contact with said rear stator, 3) a center diaphragm positioned in a spaced relationship between the inner side of said front stator and the inner side of said rear stator, said center diaphragm comprising:

(a) a first film having a conductive surface that faces inward and a non-conductive surface that faces outward, (b) a second film having a conductive surface that faces inward and that interfaces with the conductive surface on the first film, and a non-conductive surface that faces outward, (c) a diaphragm electrode in electrical contact with the first film and the second b) a frame assembly dimensioned to hold said compound diaphragm in a suspended configuration which allows said center diaphragm to flex in a forward and rearward direction, and B. a transducer driver unit which interfaces with said compound diaphragm by means of the front stator electrode, the rear stator electrode and the diaphragm electrode, wherein said unit accepts an incoming audio signal and produces a corresponding signal, which causes said center diaphragm to flex in synchrony with the audio signal to produce an audio output that is applied through said front and rear stators to the outside environment.

2. The assembly as specified in claim 1 wherein at least the outer insulating member or the inner insulating member of said front stator or said rear stator is comprised of a material having structural integrity.

3. The assembly as specified in claim 2 wherein the outer insulating member and the inner insulating member is comprised of plastic.

4. The assembly as specified in claim 3 wherein the conductive layer of said front stator and said rear stator is comprised of a conductive metal.

5. The assembly as specified in claim 4 wherein the conductive layer of said front stator and said rear stator is comprised of a conductive solution that is sprayed onto the inner sides of the outer insulating members.

6. The assembly as specified in claim 5 wherein the conductive solution is comprised of a conductive paint having suspended metal particles.

7. The assembly as specified in claim 1 wherein the conductive surface of the first film and the conductive surface of the second film of said center diaphragm is in direct contact.

8. The assembly as specified in claim 1 wherein between the two conductive surfaces of said center diaphragm is located a resilient material.

9. The assembly as specified in claim 1 wherein said center diaphragm is positioned and maintained in a spaced relationship between the inner side of said front stator and the inner side of said rear stator by means of a spacing element.

10. The assembly as specified in claim 9 wherein said spacing element is comprised of single standoff dimensioned to fit around the perimeter edge of said center diaphragm.

11. The assembly as specified in claim 9 wherein said spacing element is comprised of a plurality of standoffs that are selectively positioned around the non-conductive surfaces of said center diaphragm.

12. The assembly as specified in claim 1 wherein said frame assembly comprises:

a) a front section having an inner surface, an outer surface, an upper surface, a lower surface, a right surface and a left surface, and b) a rear section having an inner surface, an outer surface, an upper surface, a lower surface, a right surface and a left surface wherein between the two inner surfaces is suspended said compound diaphragm and wherein the front section and rear section are attached by an attachment means.

13. The assembly as specified in claim 12 wherein at least two said capacitive transducers are placed in a horizontal configuration with the right surface of a first frame assembly abutting the left surface of a second frame assembly, wherein the front stator electrodes, the rear stator electrodes and the diaphragm electrodes are electrically connected in parallel to produce a single front stator, rear stator and diaphragm electrode wherein the three electrodes interface with said transducer driver unit.

14. The assembly as specified in claim 12 wherein at least two said capacitive transducers are placed in a horizontal configuration with the right surface of a first frame assembly having a space with the left surface of a second frame assembly, wherein the front stator electrodes, the rear stator electrodes and the diaphragm electrodes are electrically connected in parallel to produce a single front stator, rear stator and diaphragm electrode, wherein the three electrodes interface with said transducer driver unit.

15. The assembly as specified in claim 12 wherein at least two said capacitive transducers are placed in a vertical configuration with the upper surface of a first frame assembly abutting with the lower surface of a second fame assembly, wherein the front stator electrodes, the rear stator electrodes and the diaphragm electrodes are electrically connected in parallel to produce a single front stator, rear stator and diaphragm electrode, wherein the three electrodes interface with said transducer driver unit.

16. The assembly as specified in claim 12 wherein at least two said capacitive transducers are placed in a horizontal configuration with the inner surface of a first frame assembly abutting with the outer surface of a second frame assembly, wherein the front stator electrodes, the rear stator electrodes and the diaphragm electrodes are electrically connected in parallel to produce a single front stator, rear stator and diaphragm electrode, wherein the three electrodes interface with said transducer driver unit.

17. The assembly as specified in claim 16 wherein in the inner-to-outer surface, horizontal configuration each pair of capacitive transducers share a common stator.

18. The assembly as specified in claim 16 wherein the capacitive transducers are maintained in an abutted configuration by means of an adhesive or a plurality of clamps.

* * * * *